US010485308B2

(12) United States Patent
Lin

(10) Patent No.: US 10,485,308 B2
(45) Date of Patent: Nov. 26, 2019

(54) ZIPPER HEAD ASSEMBLY STRUCTURE AND ELASTIC MEMBER THEREOF

(71) Applicant: CHUNG CHWAN ENTERPRISE CO., LTD., Taoyuan (TW)

(72) Inventor: Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 0 days.

(21) Appl. No.: 16/016,717

(22) Filed: Jun. 25, 2018

(65) Prior Publication Data

US 2019/0208870 A1 Jul. 11, 2019

(30) Foreign Application Priority Data

Jan. 8, 2018 (TW) ..... 107100654 A

(51) Int. Cl.
*A44B 19/26* (2006.01)
*A44B 19/30* (2006.01)

(52) U.S. Cl.
CPC ..... *A44B 19/262* (2013.01); *A44B 19/306* (2013.01)

(58) Field of Classification Search
CPC ..... A44B 19/262; A44B 19/306
See application file for complete search history.

(56) References Cited

U.S. PATENT DOCUMENTS 4,081,883 A * 4/1978 Ishii ..... A44B 19/306 24/421
4,139,928 A * 2/1979 Aoki ..... A44B 19/26 24/424
4,271,567 A * 6/1981 Aoki ..... A44B 19/306 24/421
4,287,646 A * 9/1981 Kanzaka ..... A44B 19/308 24/424
4,768,263 A * 9/1988 Fukuroi ..... A44B 19/306 24/418
5,896,628 A * 4/1999 Oda ..... A44B 19/306 24/421

(Continued)

FOREIGN PATENT DOCUMENTS

CN 101953547 A 1/2011
CN 202269481 U 6/2012

(Continued)

*Primary Examiner* — Robert Sandy
*Assistant Examiner* — David M Upchurch
(74) *Attorney, Agent, or Firm* — Li & Cai Intellectual Property (USA) Office

(57) ABSTRACT

A zipper head assembly structure includes a sliding member, an elastic member and a pulling member. The sliding member has a first fixing base, a second fixing base and a through opening. The elastic member is disposed on the sliding member. The elastic member has a first fixing section mated with the first fixing base, a second fixing section mated with the second fixing base, and an inserting section movably passing through the through opening. The pulling member is mated with the elastic member. The first fixing section has a first groove structure, and the second fixing section has a second groove structure. The first fixing base is partially inserted into the first groove structure so as to fix the first fixing section in position, and the second fixing base is partially inserted into the second groove structure so as to fix the second fixing section in position.

10 Claims, 13 Drawing Sheets

(56) References Cited

U.S. PATENT DOCUMENTS

| | | | | |
|---|---|---|---|---|
| 6,314,624 | B1 * | 11/2001 | Lin | A44B 19/308 24/421 |
| 6,588,072 | B1 * | 7/2003 | Lin | A44B 19/265 24/416 |
| 6,637,078 | B2 * | 10/2003 | Nagata | A44B 19/306 24/419 |
| 6,769,156 | B1 * | 8/2004 | Chen | A44B 19/306 24/419 |
| 8,584,326 | B2 * | 11/2013 | Keyaki | A44B 19/306 24/420 |
| 2005/0076480 | A1 * | 4/2005 | Chen | A44B 19/306 24/415 |

FOREIGN PATENT DOCUMENTS

| | | |
|---|---|---|
| TW | 569683 | 1/2004 |
| TW | M268959 | 7/2005 |

* cited by examiner

ZIPPER HEAD ASSEMBLY STRUCTURE AND ELASTIC MEMBER THEREOF

CROSS-REFERENCE TO RELATED PATENT APPLICATION

This application claims the benefit of priority to Taiwan Patent Application No. 107100654, filed on Jan. 8, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a zipper head assembly structure and an elastic member thereof, and more particularly to a zipper head assembly structure and an elastic member thereof with increased fixing and positioning effects.

BACKGROUND OF THE DISCLOSURE

Basic fabric binding and unbinding components for ordinary clothing include buttons or zipper structures. Compared to buttons, zipper structures have better usability and firmer structural properties. A conventional zipper structure has a zipper head and a zipper tape. The zipper head cooperates with the zipper tape to serve as a zipping component capable of reciprocating movement, enabling a broad application of zipper structures on clothing and accessories. However, there is still room for improvement for a conventional zipper structure.

SUMMARY OF THE DISCLOSURE

In response to the above-referenced technical inadequacies, the present disclosure provides a zipper head assembly structure and an elastic member thereof.

In certain aspects, the present disclosure provides a zipper head assembly structure including a sliding member, an elastic member and a pulling member. The sliding member has a first sliding body, a second sliding body corresponding to the first sliding body, and a connecting body connected between the first sliding body and the second sliding body. The first sliding body has a first fixing base, a second fixing base and a through opening. The elastic member is disposed on the sliding member. The elastic member has a first fixing section configured to mate with the first fixing base, a second fixing section configured to mate with the second fixing base, an elastic section connected to the second fixing section, a pulling section connected to the elastic section, and an inserting section connected to the pulling section. The inserting section is configured to movably pass through the through opening. The pulling member and the elastic member are configured to mate with each other. The pulling member has a pivot body disposed between the sliding member and the elastic member. The first fixing base has a first groove structure. A part of the first fixing base is inserted into the first groove structure so as to limit a horizontal movement of the first fixing section relative to the first fixing base. The second fixing base has a second groove structure. A part of the second fixing base is inserted into the second groove structure so as to limit a horizontal movement of the second fixing section relative to the second fixing base.

In certain aspects, the present disclosure provides a zipper head assembly structure including a sliding member, an elastic member and a pulling member. The sliding member has a first fixing base, a second fixing base and a through opening. The elastic member is disposed on the sliding member, and has a first fixing section configured to mate with the first fixing base, a second fixing section configured to mate with the second fixing base, and an inserting section configured to movably pass through the through opening. The pulling member and the elastic member are configured to mate with each other. A part of the first fixing base is inserted into the first groove structure so as to fix the first fixing section in position. A part of the second fixing base is inserted into the second groove structure so as to fix the second fixing section in position.

In certain aspects, the present disclosure provides an elastic member. The elastic member is disposed on a sliding member of a zipper head assembly structure. The elastic member includes a first fixing section, a second fixing section, an elastic section, a pulling section and an inserting section. The first fixing section is configured to mate with a first fixing base of the sliding member. The second fixing section is configured to mate with a second fixing base of the sliding member. The elastic section is connected to the second fixing section. The pulling section is connected to the elastic section. The inserting section is connected to the pulling section. The first fixing section has a first groove structure. A part of the first fixing base is inserted into the first groove structure so as to fix the first fixing section in position. The second fixing section has a second groove structure. A part of the second fixing base is inserted into the second groove structure so as to fix the second fixing section in position.

One of the beneficial effects of the present disclosure is that, through the technical features of "the first fixing section has a first groove structure, and a part of the first fixing base is inserted into the first groove structure" and "the second fixing section has a second groove structure, and a part of the second fixing base is inserted into the second groove structure," the zipper head assembly structure and its elastic member, as provided by the present disclosure, can fix the first fixing section and the second fixing section in position. Therefore, the present disclosure can use the first groove structure and the second groove structure to respectively increase the fixing and positioning effects of the first fixing section and the second fixing section of the elastic member.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
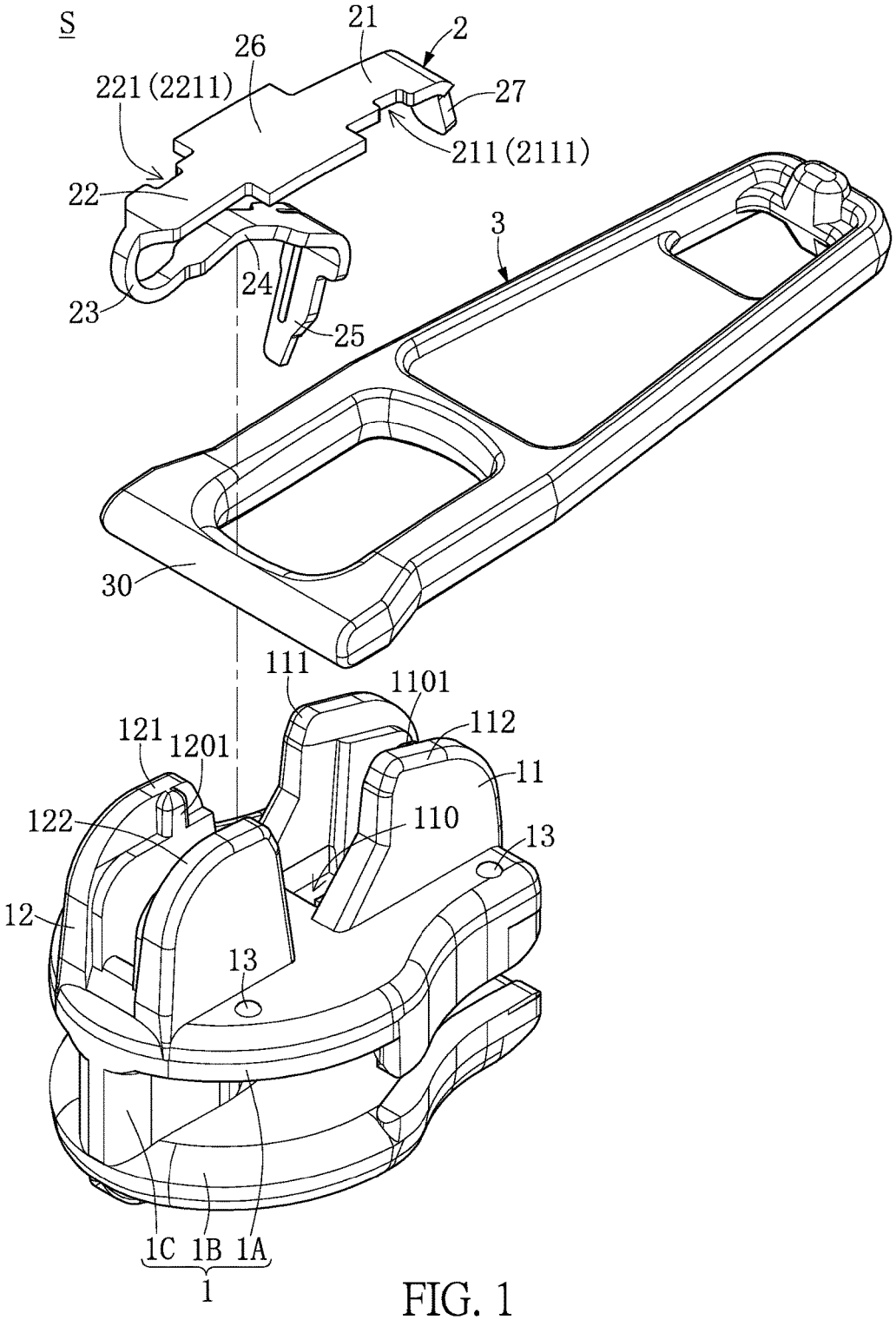
FIG. 1 is a perspective exploded view of a zipper head assembly structure according to a first embodiment of the present disclosure.
Figure 2:
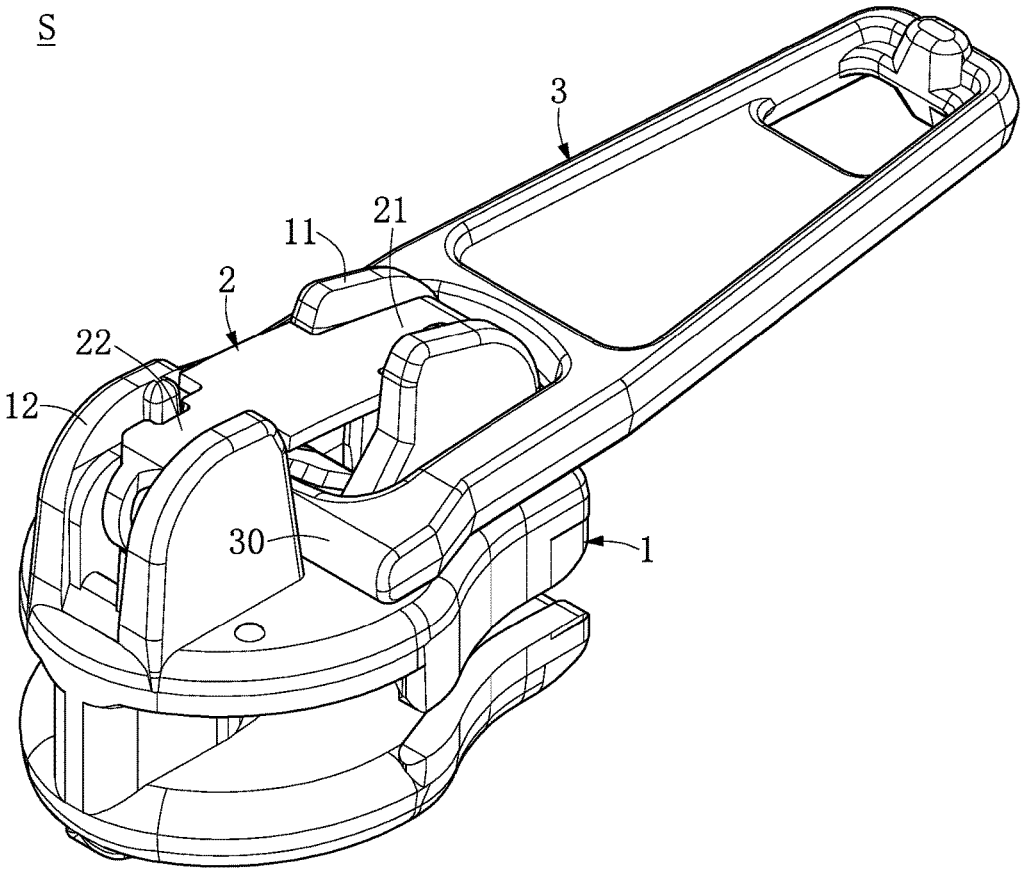
FIG. 2 is a perspective assembled view of the zipper head structure of the first embodiment of the present disclosure before it undergoes a riveting process.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be expressed in more than one way. Consequently, alternative language and synonyms may be used for any one or more of the terms discussed herein, and no special significance is to be placed upon whether or not a term is elaborated or discussed herein. Synonyms for certain terms may be provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including any definitions given herein, will prevail.

While numbering terms such as "first", "second" or "third" may be used in this disclosure to describe various components, signals or the like, the terms are for distinguishing one component from another component, or one signal from another signal only, and are not intended to, nor should they be construed to impose any other substantive descriptive limitations on the components, signals or the like.

First Embodiment

Figure 3:
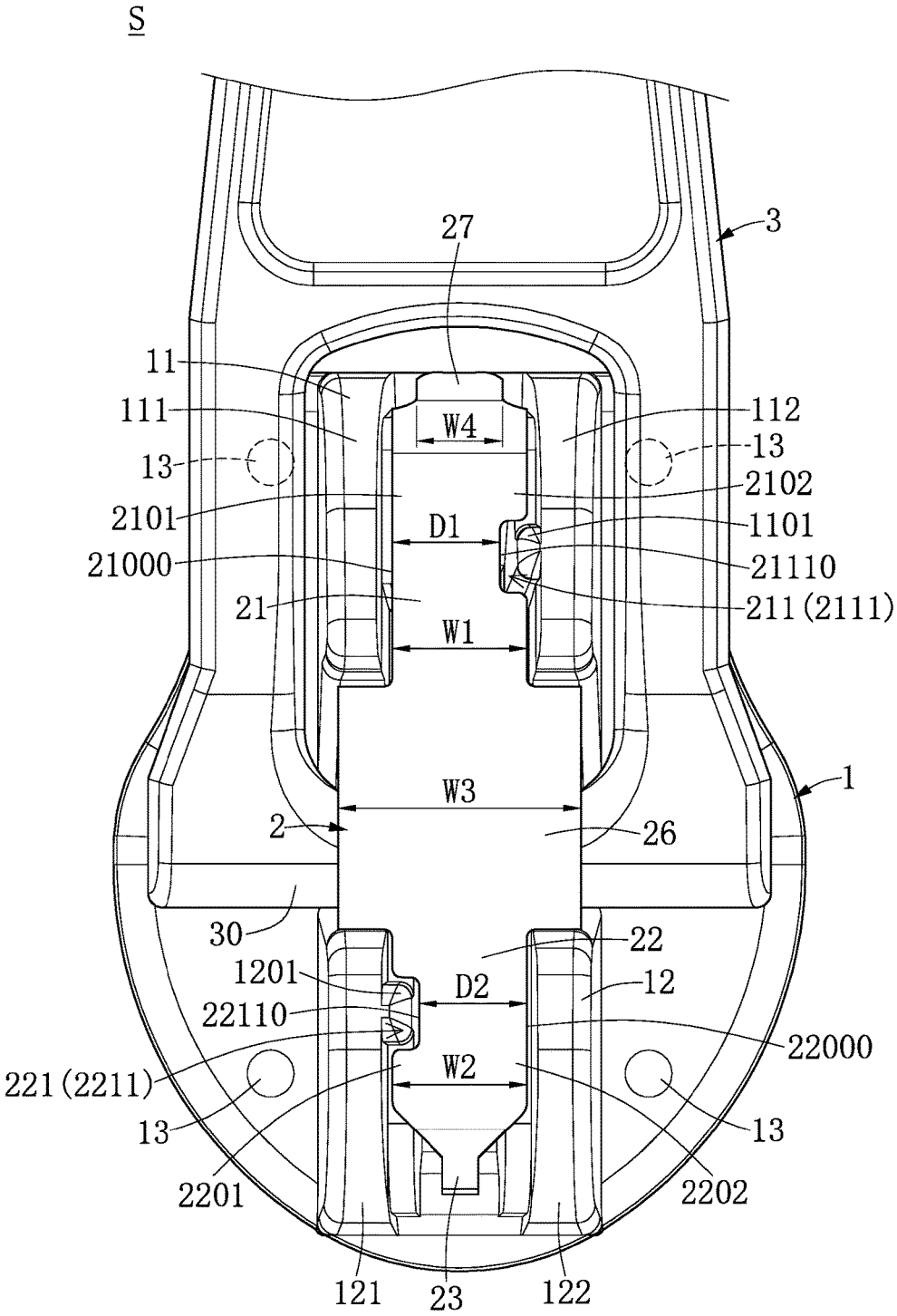
FIG. 3 is a top assembled view of the zipper head structure of the first embodiment of the present disclosure before it undergoes a riveting process.
Figure 4:
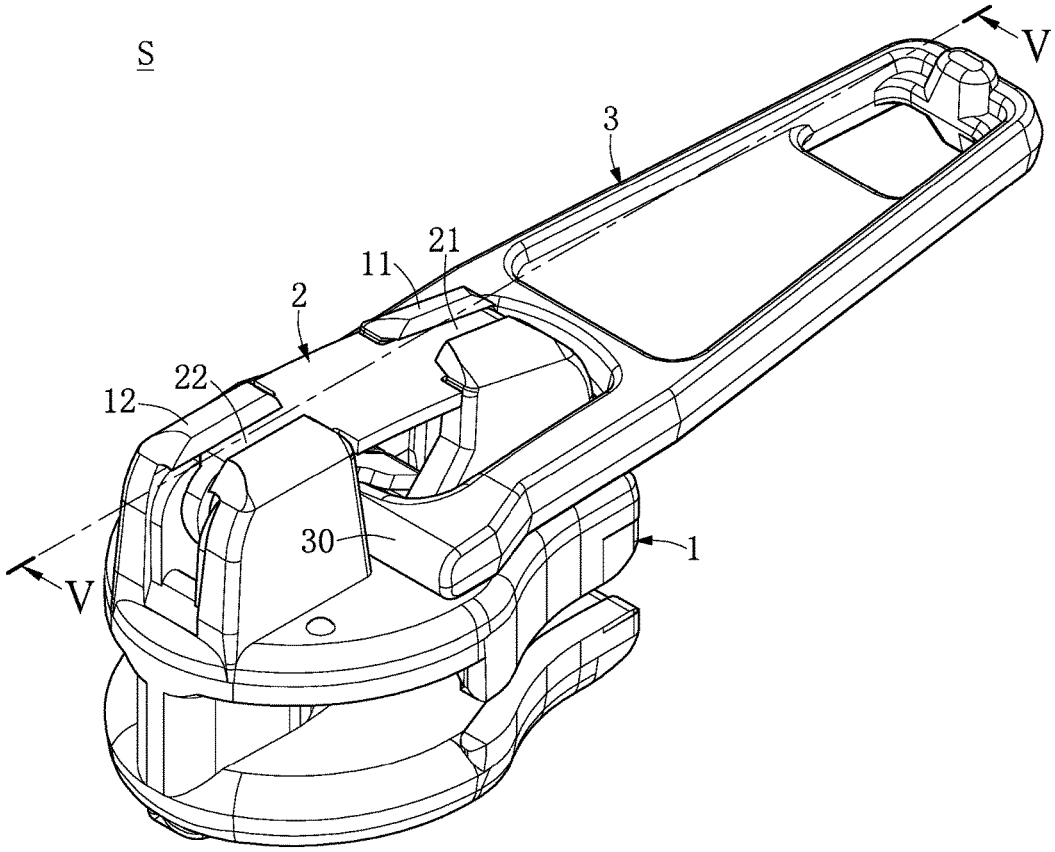
FIG. 4 is a perspective assembled view of the zipper head structure of the first embodiment of the present disclosure after it has undergone a riveting process.
Figure 5:
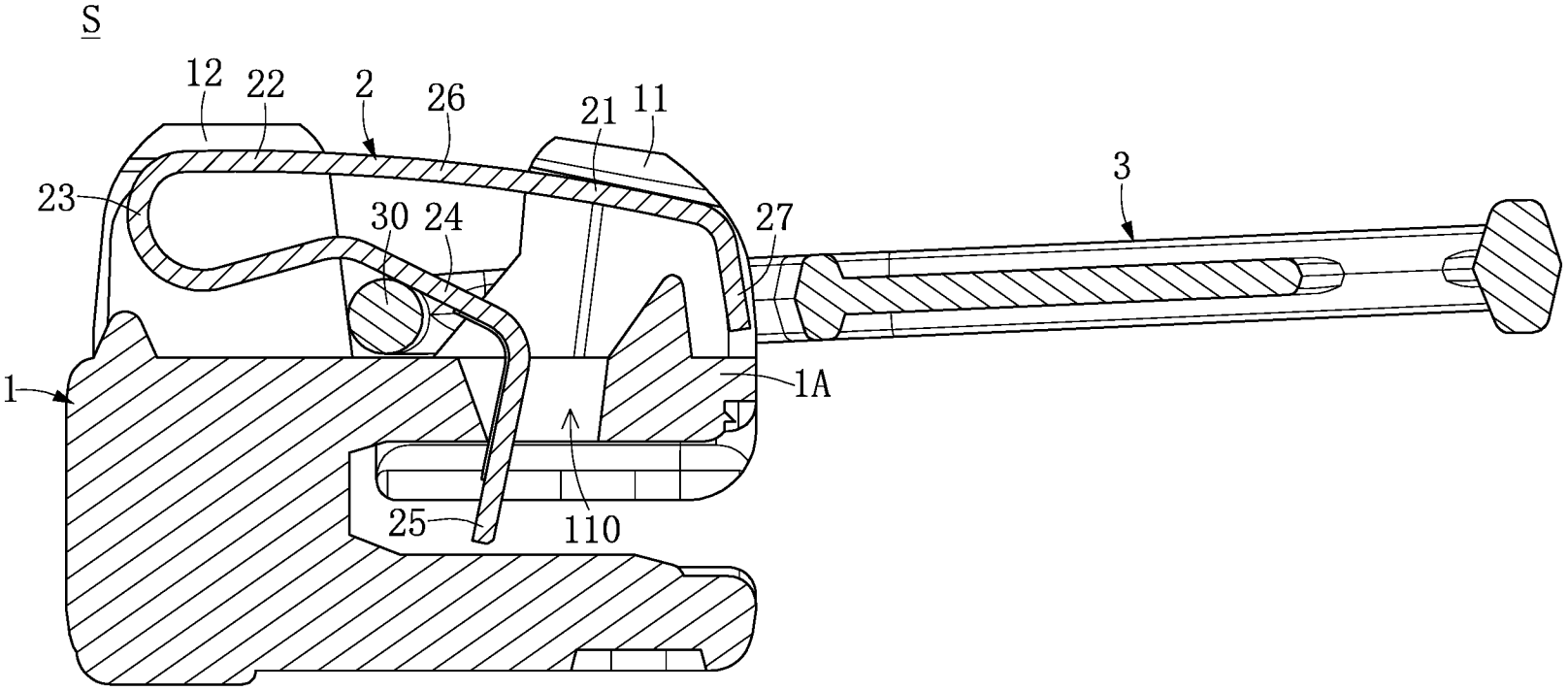
FIG. 5 is a schematic cross-sectional view of the pulling member of the zipper head assembly structure being laid substantially horizontally and without pulling the pulling section according to the first embodiment of the present disclosure.

Referring to FIG. 1 to FIG. 6, the first embodiment of the present disclosure provides a zipper head assembly S including a sliding member 1, an elastic member 2, and a pulling member 3, and FIG. 5 is a cross-sectional diagram along a cross-sectional line V-V of FIG. 4.

First, as shown in FIG. 1, FIG. 3 and FIG. 5, the sliding member 1 has a first sliding body 1A, a second sliding body 1B corresponding to the first sliding body 1A, and a connecting body connected between the first sliding body 1A and the second sliding body 1B. For example, the sliding member 1 may be integrally formed by the first sliding body 1A, the second sliding body 1B and the connecting body 1C. However, the present disclosure is not limited thereto. In addition, the first sliding body 1A has a first fixing base 11, a second fixing base 12, and a through opening 110. For example, the through opening 110 penetrates the first sliding body 1A, and the through opening 110 is closer to the first fixing base 11 than the second fixing base 12 is. However, the present disclosure is not limited thereto.

Further, as shown in FIGS. 1, 3 and 5, the elastic member 2 is disposed on the sliding member 1. Further, the elastic member 2 has a first fixing section 21 mating with the first fixing seat 11, a second fixing section 22 mating with the second fixing seat 12, an elastic section 23 connected to the second fixing section 22, a pulling section 24 connected to the elastic section 23, and an inserting section 25 connected to the pulling section 24. The inserting section 25 can movably pass through the through opening 110. For example, the elastic member 2 has a fully exposed connecting section 26 connected between the first fixing section 21 and the second fixing section 22, and a tail end fixing section 27 connected to the first fixing section 21. The fully exposed connecting section 26 is disposed between the first fixing base 11 and the second fixing base 12, and disposed between the first fixing seat 11 and the second fixing seat 11. The tail end fixing section 27 and the first fixing seat 11 can mate with each other. However, the present disclosure is not limited thereto.

Figure 6:
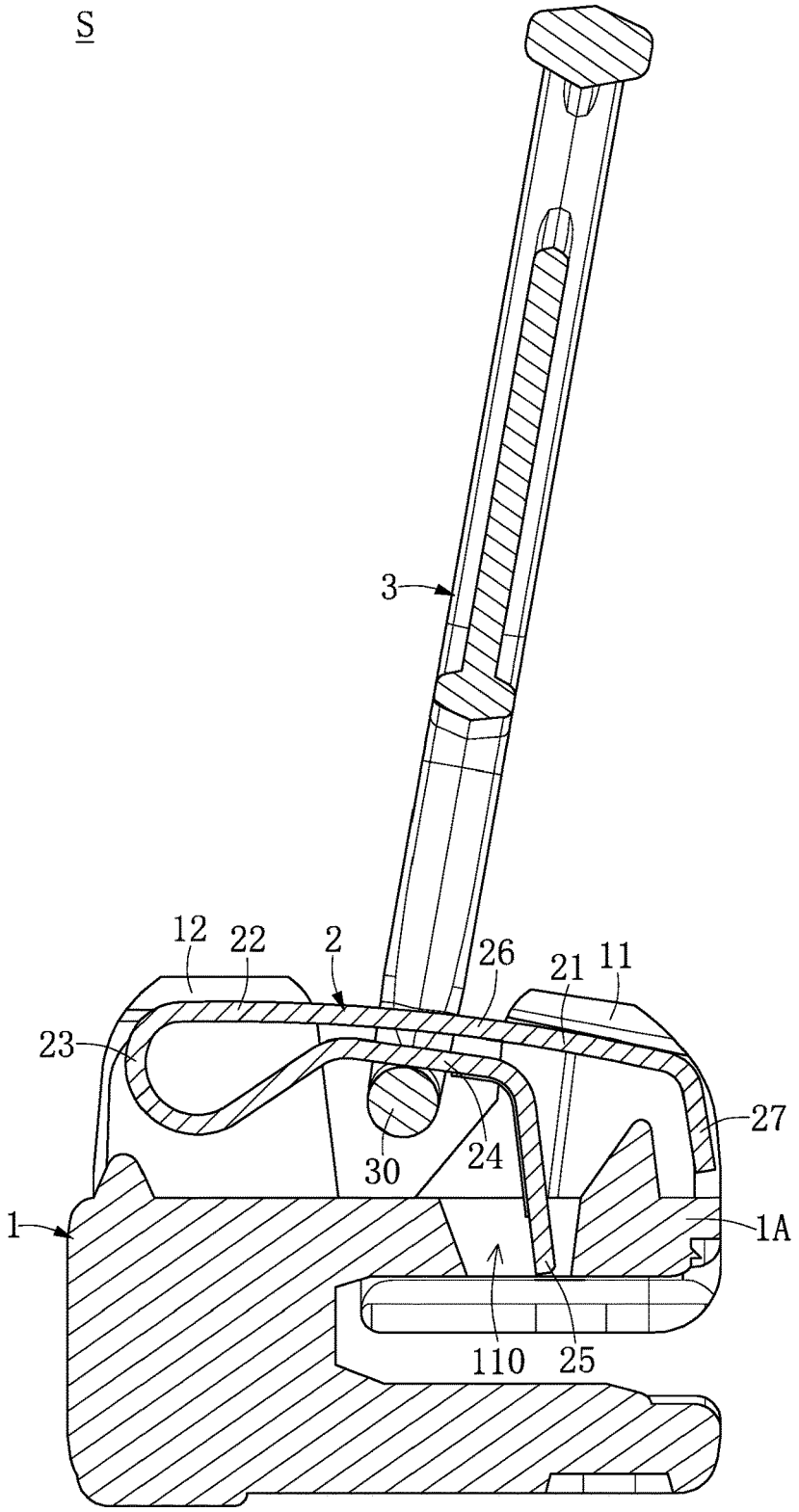
FIG. 6 is a schematic cross-sectional view of the pulling member of the zipper head assembly structure being raised and pulling the pulling section according to the first embodiment of the present disclosure.

In addition, as shown in FIG. 1, FIG. 3, FIG. 5 and FIG. 6, the pulling member 3 and the elastic member 2 can mate with each other, and the pulling member 3 has a pivot body 30 disposed between the sliding member 1 and the elastic member 2. For example, as shown in FIG. 5, when the pulling member 3 is laid substantially horizontally without pulling the pulling section 24 (that is, the pulling member 3 being laid "substantially horizontally" can also, in certain embodiments, be defined as being laid to an extent where the pulling section 24 is not pulled thereby), a part of the inserting section 25 passes through the through opening 110 and protrudes out from a place below the first sliding body 1A. As shown in FIG. 6, when the pulling member 3 is raised and pulls the pulling section 24, the part of the insertion section 25 retracts into the through opening 110 without protruding out from a place below the first sliding body 1A. However, the present disclosure is not limited thereto.

Further, as shown in FIG. 1, FIG. 3 and FIG. 4, the first fixing section 21 has a first groove structure 211. A part of the first fixing base 11 is inserted into the first groove structure 211 so as to limit the movement of the first fixing section 21 relative to the first fixing base 11 in the horizontal direction, thereby fixing the first fixing section 21 in position. Therefore, the first fixing section 21 does not easily disengage from the first fixing base 11 when the pulling member 3 is pulled or twisted. In addition, the second fixing section 22 has a second groove structure 221. A part of the second fixing base 12 is inserted into the second groove structure 221 so as to limit the movement of the second fixing section 22 relative to the second fixing base 12 in the horizontal direction, thereby fixing the second fixing section 22 in position. Therefore, the second fixing section 22 does not easily disengage from the second fixing base 12 when the pulling member 3 is pulled or twisted.

Further, for example, as shown in FIG. 1, FIG. 3 and FIG. 4, the first fixing base 11 has a first left covering portion 111 and a first right covering portion 112. After the first left covering portion 111 and the first right covering portion 112 are further processed (such as after a riveting process shown in FIG. 4), a left end portion 2101 of the first fixing section 21 is covered by the first left covering portion 111 and fixed on the first fixing base 11, and a right end portion 2102 of the first fixing section 21 is covered by the first right covering portion 112 and fixed on the first fixing base 11. In addition, the second fixing base 12 has a second left covering portion 121 and a second right covering portion 122. After the second left covering portion 121 and the second right covering portion 122 are further processed (such as after a riveting process shown in FIG. 4), a left end portion 2201 of the second fixing section 22 is covered by the second left covering portion 121 and fixed on the second fixing base 12, and a right end portion 2202 of the second fixing section 22 is covered by the second right covering portion 122 and fixed on the second fixing base 12. However, the present disclosure is not limited thereto.

Further, for example, as shown in FIG. 1, FIG. 3 and FIG. 4, the first groove structure 211 has at least one first groove 2111, and the first fixing base 11 has at least one protrusion body 1101 inserted into the at least one first groove 2111. That is, when the left end portion 2101 of the first fixing section 21 is covered by the first left covering portion 111, at least one first protrusion body 1101 is squeezed and inserted into the at least one first groove 2111, so that the first fixing section 21 can be firmly fixed on the first fixing base 11 through the mating of the first protrusion body 1101 and the first groove 2111. In addition, the second groove structure 221 has at least one second groove 2211, and the second fixing base 12 has at least one second protrusion body 1201 inserted into the at least one second groove 2211. That is, when the left end portion 2201 of the second fixing section 22 is covered or enveloped by the second left covering portion 121, at least one second protrusion body 1201 is squeezed and inserted into the at least one second groove 2211, so that the second fixing section 22 can be firmly fixed to the second fixing base 12 through the mating of the second protrusion body 1201 and the second groove 2211. However, the present disclosure is not limited thereto.

Further, for example, as shown in FIG. 3, the width W1 of the first fixing section 21 and the width W2 of the second fixing section 22 are smaller than the width W3 of the fully exposed connecting section 26. Both the width W1 of the first fixing section 21 and the width W2 of the second fixing section 22 are greater than the width W4 of the tail end fixing section 27. A distance D1 from an inner side surface 21110 of the at least one first groove 2111 to an outer side surface 21000 of the first fixing section 21 is smaller than the width W1 of the first fixing section 21. A distance D2 between an inner side surface 22110 of the at least one second groove 2211 and an outer side surface 22000 of the second fixing section 22 is smaller than the width W2 of the second surface section 22. However, the present disclosure is not limited thereto.

Figure 7:
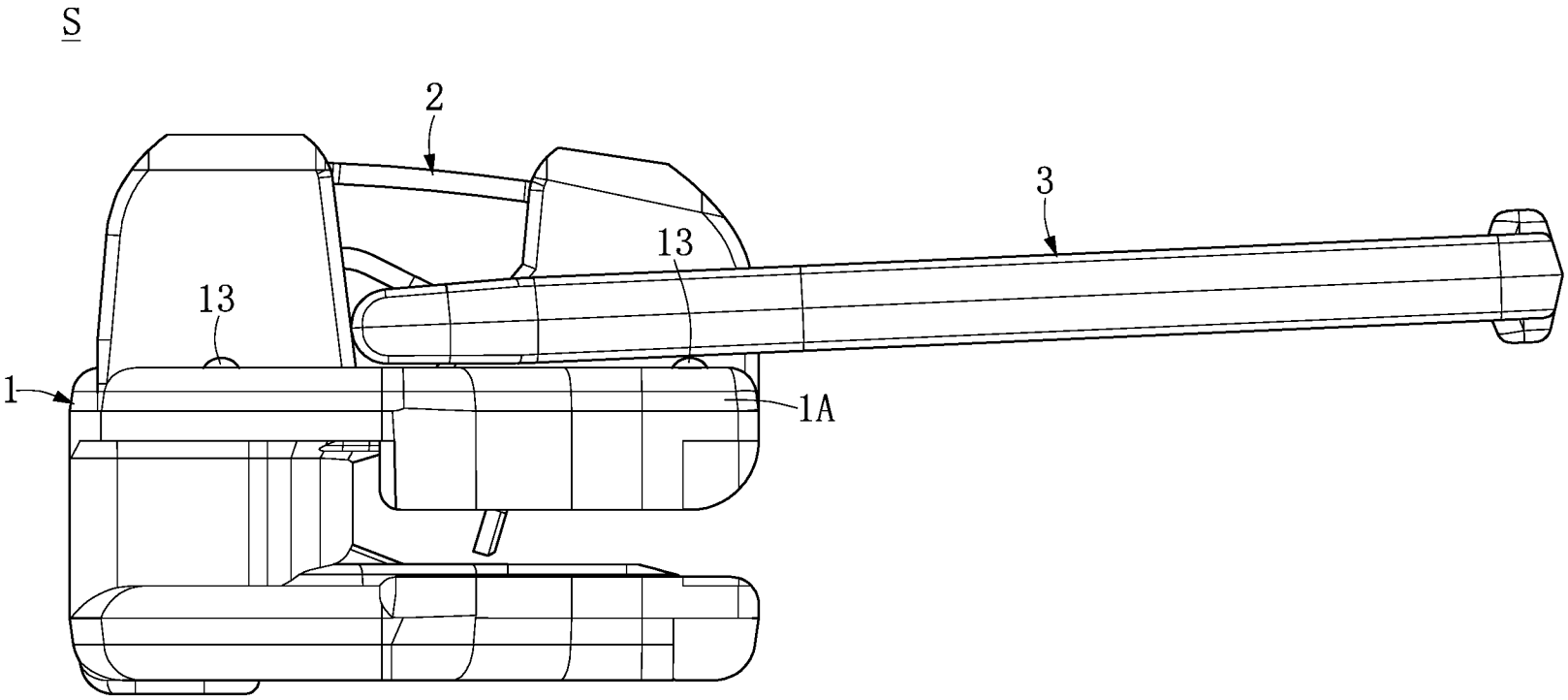
FIG. 7 is one schematic view of the pulling member of the zipper head assembly structure being laid substantially horizontally and abutting against a bump according to the first embodiment of the present disclosure.
Figure 8:
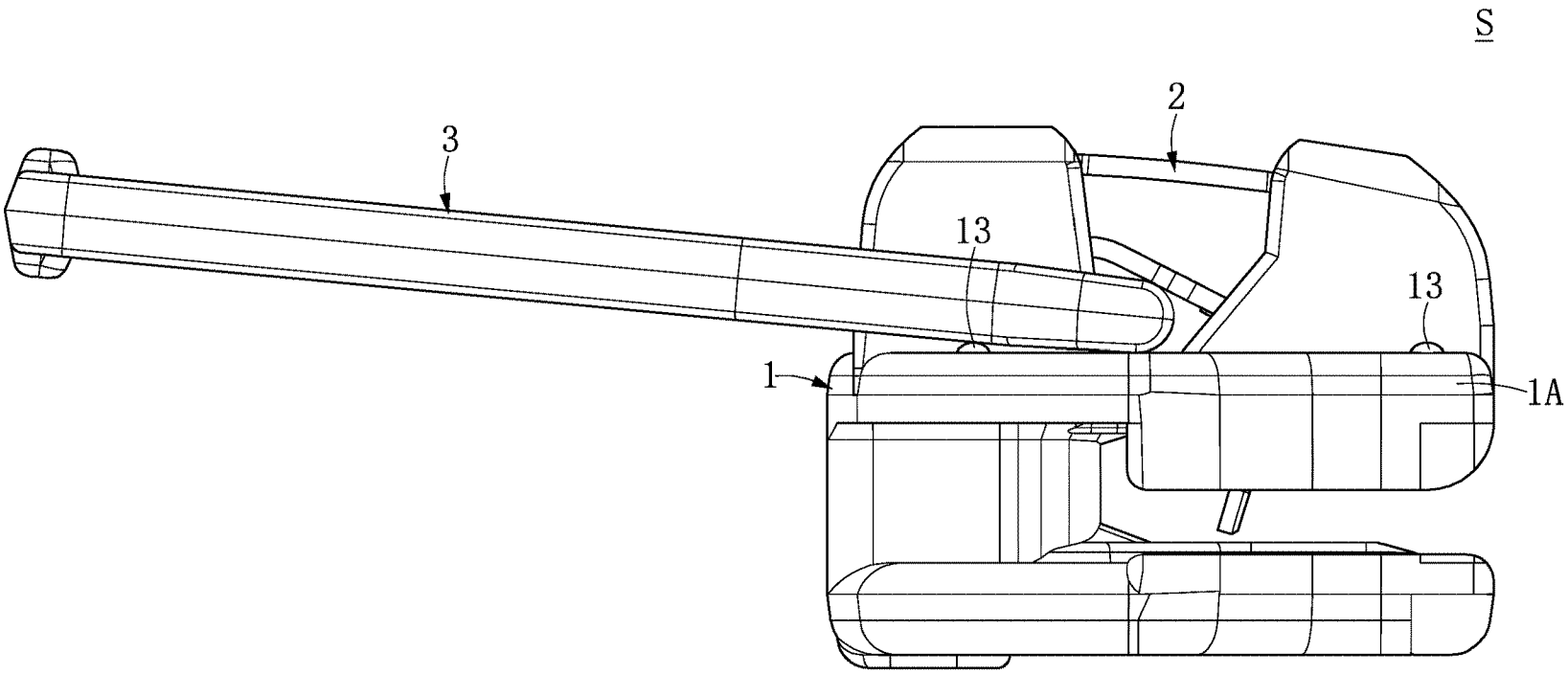
FIG. 8 is another schematic view of the pulling member of the zipper head assembly structure being laid substantially horizontally and abutting against a bump according to the first embodiment of the present disclosure.

It is worth mentioning that, as shown in FIG. 7 and FIG. 8, when the pulling member 3 is laid substantially horizontally, the pulling member 3 abuts against a bump 13 and is not entirely directly placed on the first sliding body 1A. Therefore, the contacting area between the pulling member 3 and the first sliding body 1A can be reduced by the use of the bump 13. However, the present disclosure is not limited thereto.

It is worth mentioning that, as shown in FIG. 3, in the example of the first embodiment of the present disclosure, the first protrusion body 1101 and the second protrusion body 1201 can be arranged "diagonally" on the sliding member 1, and the first groove 2111 and the second groove 2211 can be "diagonally" disposed on the elastic member 2. However, the present disclosure is not limited thereto.

Second Embodiment

Figure 9:
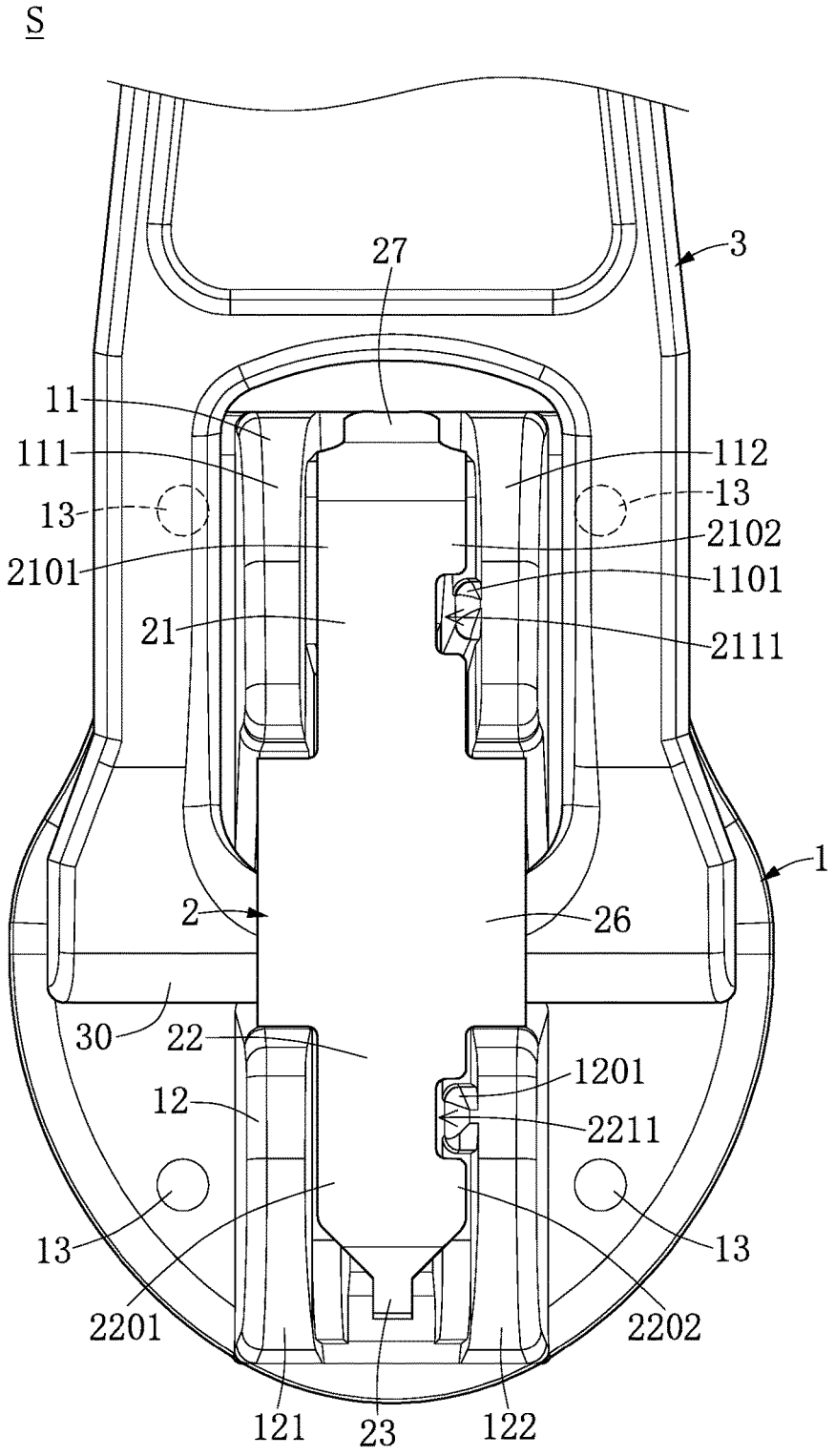
FIG. 9 is a top assembled view of a zipper head structure of a second embodiment of the present disclosure before it undergoes a riveting process.

Referring to FIG. 9, the second embodiment of the present disclosure provides a zipper head assembly structure S including a sliding member 1, an elastic member 2 and a pulling member 3. It can be seen from a comparison between FIG. 9 and FIG. 3 that the differences between the second embodiment and first embodiment include: in the example of the second embodiment of the present disclosure, the first protrusion body 1101 and the second protrusion body 1201 can be arranged "in a straight line (arranged on the same side surface)" on the sliding member 1, and the first groove 2111 and the second groove 2211 can be arranged "in a straight line (arranged on the same side surface)" on the elastic member 2. However, the present disclosure is not limited thereto.

Third Embodiment

Figure 10:
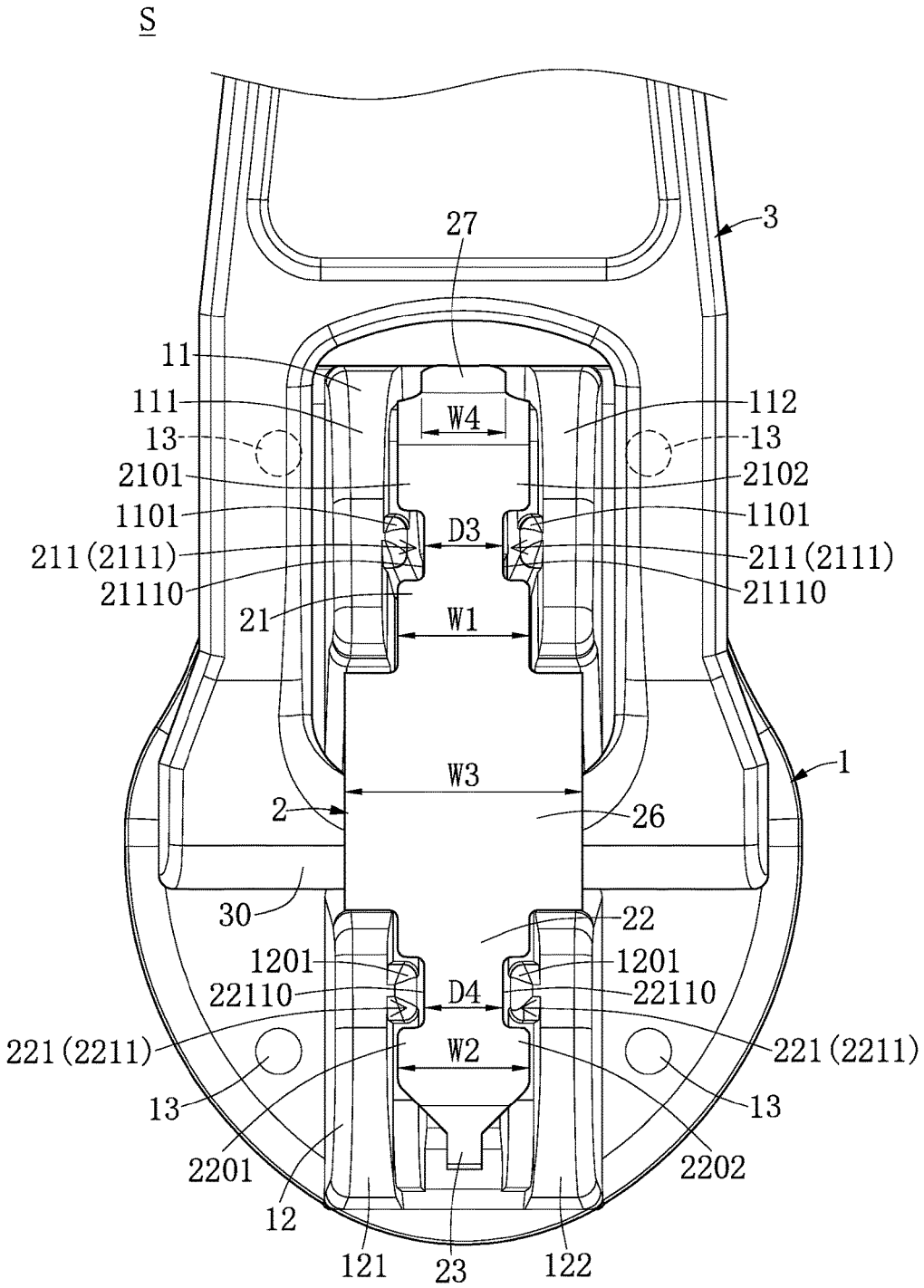
FIG. 10 is a top assembled view of a zipper head structure of a third embodiment of the present disclosure before it undergoes a riveting process.

Referring to FIG. 10, the third embodiment of the present disclosure provides a zipper head assembly structure S including a sliding member 1, an elastic member 2 and a pulling member 3. It can be seen from a comparison between FIG. 10 and FIG. 3 that the differences between the third embodiment and first embodiment include the following.

First, the first groove structure 211 has two first grooves 2111 arranged opposite to each other, and the first fixing base 11 has two first protrusion bodies 1101 inserted into the two first grooves 2111, respectively. That is, when the left end portion 2101 and the right end portion 2102 of the first fixing section 21 are covered by the first left covering portion 111 and the first right covering portion 112, respectively, the two first protrusion bodies 1101 are squeezed and inserted into the two first grooves 2111, respectively, so that the first fixing section 21 is firmly fixed on the first fixing base 11 through the mating of the two first protrusion bodies 1101 and the two first grooves 2111.

Second, the second groove structure 221 has two second grooves 2211 arranged opposite to each other, and the second fixing base 12 has two second protrusion bodies 1201 inserted into the two second grooves 2211, respectively. That is, when the left end portion 2201 and the right end portion 2202 of the second fixing section 22 are covered by the second left covering portion 121 and the second right covering portion 122, respectively, the two second protrusion bodies 1201 are squeezed and inserted into the two second grooves 2211, respectively, so that the second fixing section 22 is firmly fixed on the second fixing base 12 through the mating of the two second protrusion bodies 1201 and the two second grooves 2211.

Further, for example, the width W1 of the first fixing section 21 and the width W2 of the second fixing section 22 are smaller than the width W3 of the fully exposed connecting section 26. Both the width W1 of the first fixing section 21 and the width W2 of the second fixing section 22 are greater than the width W4 of the tail end fixing section 27. A distance D3 from an inner side surface 21110 of a first groove 2111 to an inner side surface 21110 of another first groove 2111 is smaller than the width W1 of the first fixing section 21. A distance D2 between an inner side surface 22110 of a second groove 2211 and an inner side surface 22110 of another second groove 2211 is smaller than the width W2 of the second surface section 22. However, the present disclosure is not limited thereto.

Fourth Embodiment

Figure 11:
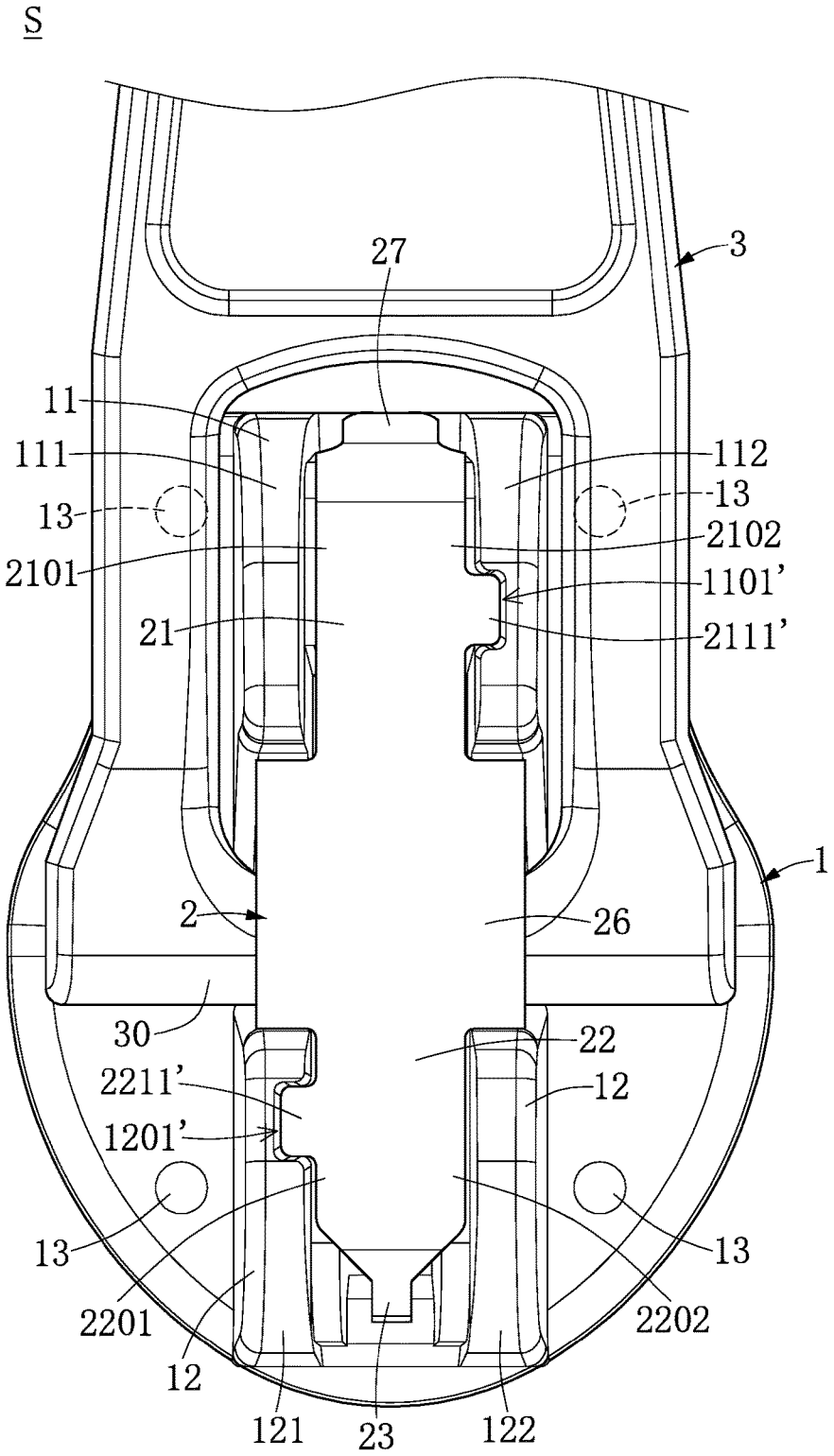
FIG. 11 is a top assembled view of a zipper head structure of a fourth embodiment of the present disclosure before it undergoes a riveting process.

Referring to FIG. 11, the fourth embodiment of the present disclosure provides a zipper head assembly structure S including a sliding member 1, an elastic member 2 and a pulling member 3. It can be seen from a comparison between FIG. 11 and FIG. 3 that the differences between the fourth embodiment and first embodiment include: the first groove 2111 and second groove 2211 of the first embodiment are replaced by at least one first protrusion body 21111 and at least one second protrusion body 22111, respectively, and the first protrusion body 1101 and second protrusion 1201 of the first embodiment are replaced by at least one groove 11011 and at least one second groove 12011, respectively.

Therefore, when the left end portion 2101 of the first fixing section 21 is covered by the first left covering portion 111, the first protrusion body 21111 is squeezed and inserted into the first groove 11011, so that the first fixing section 21 is firmly fixed on the first fixing base 11 through the mating of the first protrusion body 21111 and the first groove 11011. In addition, when the left end portion 2201 of the second fixing section 22 is covered by the second left covering portion 121, the second protrusion body 22111 is squeezed and inserted into the second groove 12011, so that the second fixing section 22 is firmly fixed on the second fixing base 12 through the mating of the second protrusion body 22111 and the second groove 12011. However, the present disclosure is not limited thereto.

Fifth Embodiment

Figure 12:
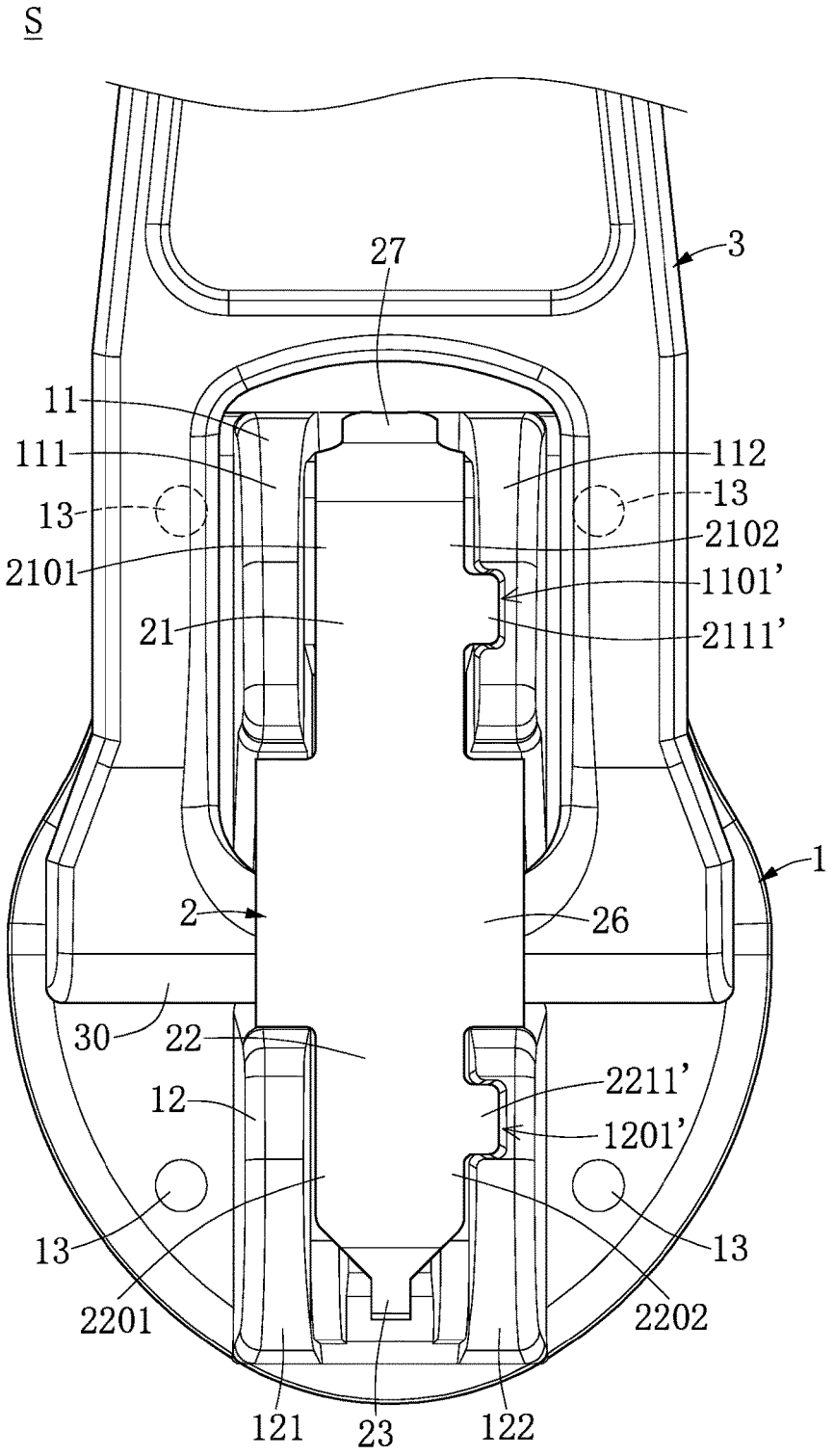
FIG. 12 is a top assembled view of a zipper head structure of a fifth embodiment of the present disclosure before it undergoes a riveting process.

Referring to FIG. 12, the fifth embodiment of the present disclosure provides a zipper head assembly structure S including a sliding member 1, an elastic member 2 and a pulling member 3. It can be seen from a comparison between FIG. 12 and FIG. 11 that the differences between the fifth embodiment and fourth embodiment include: in the example of the fifth embodiment of the present disclosure, the first protrusion body 21111 and the second protrusion body 22111 can be arranged "in a straight line (arranged on the same side surface)" on the sliding member 1, and the first groove 11011 and the second groove 12011 can be arranged "in a straight line (arranged on the same side surface)" on the elastic member 2. However, the present disclosure is not limited thereto.

Sixth Embodiment

Figure 13:
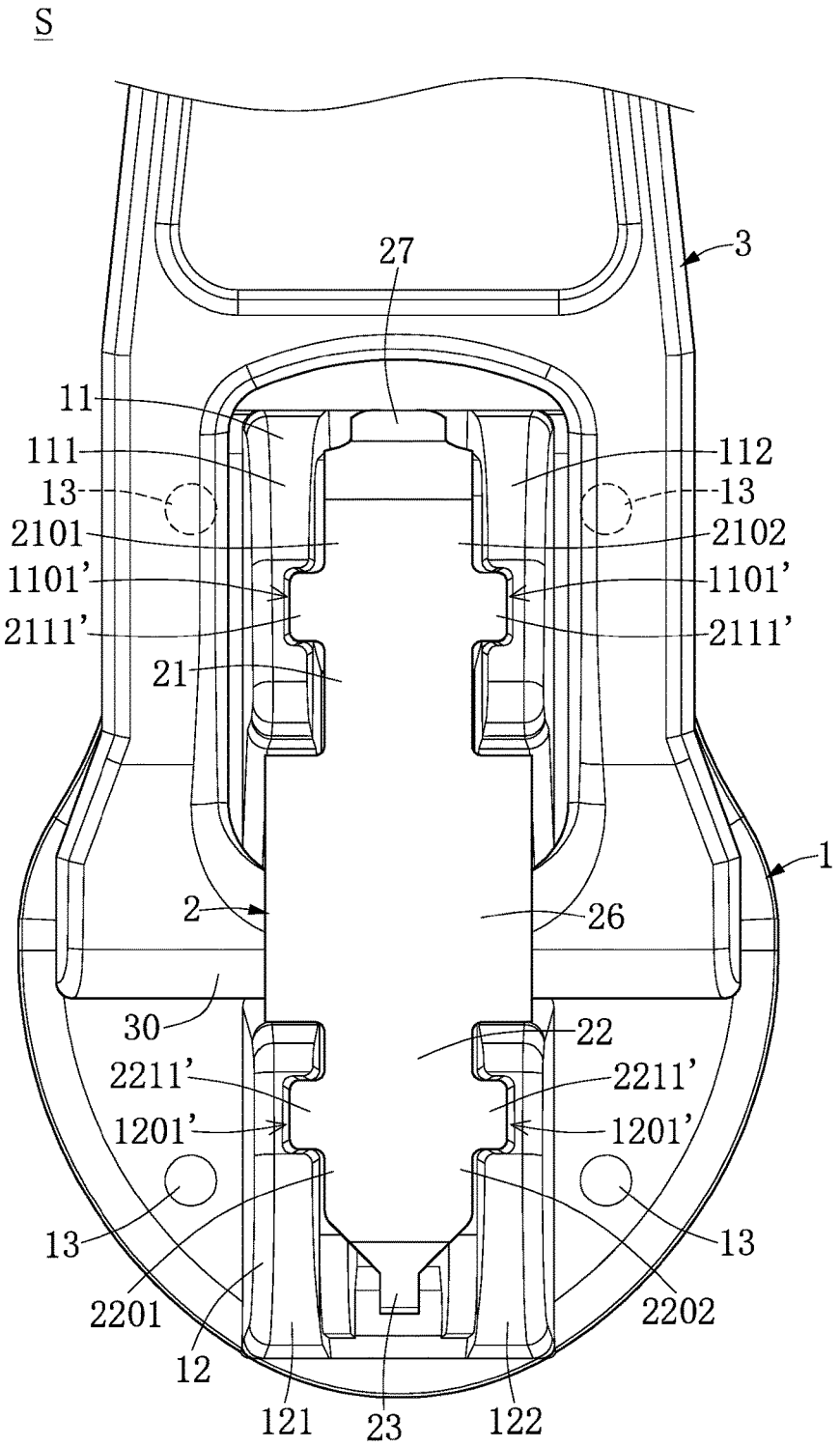
FIG. 13 is a top assembled view of a zipper head structure of a sixth embodiment of the present disclosure before it undergoes a riveting process.

Referring to FIG. 13, the sixth embodiment of the present disclosure provides a zipper head assembly structure S including a sliding member 1, an elastic member 2 and a pulling member 3. It can be seen from a comparison between FIG. 13 and FIG. 11 that the differences between the sixth embodiment and fourth embodiment include: in the example of the sixth embodiment of the present disclosure, the sixth embodiment provides two first protrusion bodies 21111, two second protrusion bodies 22111, two first grooves 11011 and two second grooves 12011. However, the present disclosure is not limited thereto.

One of the beneficial effects of the present disclosure is that, through the technical features of "the first fixing section 21 has a first groove structure 211, and a part of the first fixing base 11 is inserted into the first groove structure 211" and "the second fixing section 22 has a second groove structure 221, and a part of the second fixing base 12 is inserted into the second groove structure 221," the zipper head assembly structure S and its elastic member 2, as provided by the present disclosure, can fix the first fixing section 21 and the second fixing section 22 in position. Therefore, the present disclosure can use the first groove structure 211 and the second groove structure 221 to respectively increase the fixing and positioning effects of the first fixing section 21 and the second fixing section 22 of the elastic member 2.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A zipper head assembly structure, comprising:

a sliding member, having:

a first sliding body, having:

a first fixing base;

a second fixing base; and a through opening;

a second sliding body corresponding to the first sliding body; and a connecting body connected between the first sliding body and the second sliding body;

an elastic member, disposed on the sliding member and having:

a first fixing section configured to mate with the first fixing base;

a second fixing section configured to mate with the second fixing base;

an elastic section connected to the second fixing section;

a pulling section connected to the elastic section; and an inserting section connected to the pulling section and configured to movably pass through the through opening; and a pulling member, configured to mate with the elastic member and having a pivot body disposed between the sliding member and the elastic member, wherein the first fixing section has a first groove structure, and a part of the first fixing base is inserted into the first groove structure so as to limit a horizontal movement of the first fixing section relative to the first fixing base; and wherein the second fixing section has a second groove structure, and a part of the second fixing base is inserted into the second groove structure so as to limit a horizontal movement of the second fixing section relative to the second fixing base.

2. The zipper head assembly structure according to claim 1, wherein the elastic member has:

a fully exposed connecting section, connected between the first fixing section and the second fixing section and disposed between the first fixing base and the second fixing base; and a tail end fixing section, connected to the first fixing section and configured to mate with the first fixing base;

wherein the first fixing base has a first left covering portion and a first right covering portion, a left end portion of the first fixing section is covered by the first left covering portion so as to be fixed on the first fixing base, and a right end portion of the first fixing section is covered by the first right covering portion so as to be fixed on the first fixing base; and wherein the second fixing base has a second left covering portion and a second right covering portion, a left end portion of the second fixing section is covered by the second left covering portion so as to be fixed on the second fixing base, and a right end portion of the second fixing section is covered by the second right covering portion so as to be fixed on the second fixing base.

3. The zipper head assembly structure according to claim 2, wherein the first groove structure has at least one first groove, and the first fixing base has at least one first protrusion body inserted into the at least one first groove;

wherein the second groove structure has at least one second groove, and the second fixing base has at least one second protrusion body inserted into the at least one second groove; and wherein a first width of the first fixing section and a second width of the second fixing section are smaller than a third width of the fully exposed connecting section, the first width and the second width are greater than a fourth width of the tail end fixing section, a first distance between an inner side surface of the at least one first groove and an outer side surface of the first fixing section is smaller than the first width of the first fixing section, and a second distance between an inner side surface of the at least one second groove and an outer side surface of the second fixing section is smaller than the second width of the second fixing section.

4. The zipper head assembly structure according to claim 2, wherein the first groove structure has two first grooves arranged opposite to each other, and the first fixing base has two first protrusion bodies inserted into the two first grooves, respectively;

wherein the second groove structure has two second grooves arranged opposite to each other, and the second fixing base has two second protrusion bodies inserted into the two second grooves, respectively; and wherein a first width of the first fixing section and a second width of the second fixing section are smaller than a third width of the fully exposed connecting section, the first width and the second width are greater than a fourth width of the tail end fixing section, a third distance between an inner side surface of one of the two first grooves and an inner side surface of the other one of the first grooves is smaller than the first width of the first fixing section, and a fourth distance between an inner side surface of one of the two second grooves and an inner side surface of the other one of the second grooves is smaller than the second width of the second fixing section.

5. A zipper head assembly structure, comprising:

a sliding member, having a first fixing base, a second fixing base and a through opening;

an elastic member, disposed on the sliding member and having:

a first fixing section, configured to mate with the first fixing base and having a first groove structure;

a second fixing section, configured to mate with the second fixing base and having a second groove structure; and an inserting section configured to movably pass through the through opening; and a pulling member, configured to mate with the elastic member, wherein the first fixing section has a first groove structure, and a part of the first fixing base is inserted into the first groove structure so as to fix the first fixing section; and wherein the second fixing section has a second groove structure, and a part of the second fixing base is inserted into the second groove structure so as to fix the second fixing section.

6. The zipper head assembly structure according to claim 5, wherein the elastic member has a fully exposed connecting section, connected between the first fixing section and the second fixing section and disposed between the first fixing base and the second fixing base; and a tail end fixing section, connected to the first fixing section and configured to mate with the first fixing base;

wherein the first fixing base has a first left covering portion and a first right covering portion, a left end portion of the first fixing section is covered by the first left covering portion so as to be fixed on the first fixing base, and a right end portion of the first fixing section is covered by the first right covering portion so as to be fixed on the first fixing base; and wherein the second fixing base has a second left covering portion and a second right covering portion, a left end portion of the second fixing section is covered by the second left covering portion so as to be fixed on the second fixing base, and a right end portion of the second fixing section is covered by the second right covering portion so as to be fixed on the second fixing base.

7. The zipper head assembly structure according to claim 6, wherein the first groove structure has at least one first groove, and the first fixing base has at least one first protrusion body inserted into the at least one first groove;

wherein the second groove structure has at least one second groove, and the second fixing base has at least one second protrusion body inserted into the at least one second groove;

wherein a first width of the first fixing section and a second width of the second fixing section are smaller than a third width of the fully exposed connecting section, the first width and the second width are greater than a fourth width of the tail end fixing section, a first distance between an inner side surface of the at least one first groove and an outer side surface of the first fixing section is smaller than the first width of the first fixing section, and a second distance between an inner side surface of the at least one second groove and an outer side surface of the second fixing section is smaller than the second width of the second fixing section.

8. The zipper head assembly structure according to claim 6, wherein the first groove structure has two first grooves arranged opposite to each other, and the first fixing base has two first protrusion bodies inserted into the two first grooves, respectively;

wherein the second groove structure has two second grooves arranged opposite to each other, and the second fixing base has two second protrusion bodies inserted into the two second grooves, respectively; and wherein a first width of the first fixing section and a second width of the second fixing section are smaller than a third width of the fully exposed connecting section, the first width and the second width are greater than a fourth width of the tail end fixing section, a third distance between an inner side surface of one of the two first grooves and an inner side surface of the other one of the first grooves is smaller than the first width of the first fixing section, and a fourth distance between an inner side surface of one of the two second grooves and an inner side surface of the other one of the second grooves is smaller than the second width of the second fixing section.

9. An elastic member, configured to be disposed on a sliding member of a zipper head assembly structure and comprising:

a first fixing section, configured to mate with a first fixing base of the sliding member and having a first groove structure;

a second fixing section, configured to mate with a second fixing base of the sliding member and having a second groove structure;

an elastic section connected to the second fixing section;

a pulling section connected to the elastic section; and an inserting section connected to the pulling section and configured to movably pass through a through opening of the sliding member, wherein the first fixing section has a first groove structure, and a part of the first fixing base is inserted into the first groove structure so as to fix the first fixing section in position; and wherein the second fixing section has a second groove structure, and a part of the second fixing base is inserted into the second groove structure so as to fix the second fixing section in position.

10. The elastic member according to claim 9, further comprising:

a fully exposed connecting section, connected between the first fixing section and the second fixing section and disposed between the first fixing base and the second fixing base; and a tail end fixing section, connected to the first fixing section and configured to mate with the first fixing base, wherein the first fixing base has a first left covering portion and a first right covering portion, a left end portion of the first fixing section is covered by the first left covering portion so as to be fixed on the first fixing base, and a right end portion of the first fixing section is covered by the first right covering portion so as to be fixed on the first fixing base; and wherein the second fixing base has a second left covering portion and a second right covering portion, a left end portion of the second fixing section is covered by the second left covering portion so as to be fixed on the second fixing base, and a right end portion of the second fixing section is covered by the second right covering portion so as to be fixed on the second fixing base.

* * * * *